US007046111B2

(12) United States Patent
Sigl

(10) Patent No.: US 7,046,111 B2
(45) Date of Patent: May 16, 2006

(54) INDUCTOR ASSEMBLY

(75) Inventor: Dennis R. Sigl, Greenville, WI (US)

(73) Assignee: Illinoise Tool Works Inc., Glenview, IL (US)

( * ) Notice: Subject to any disclaimer, the term of this patent is extended or adjusted under 35 U.S.C. 154(b) by 32 days.

(21) Appl. No.: 10/065,773

(22) Filed: Nov. 18, 2002

(65) Prior Publication Data

US 2004/0095221 A1 May 20, 2004

(51) Int. Cl.
*H01F 27/30* (2006.01)

(52) U.S. Cl. ..... 336/198; 336/178

(58) Field of Classification Search ..... 336/65, 336/90, 165, 178, 192, 198
See application file for complete search history.

(56) References Cited

U.S. PATENT DOCUMENTS

| | | | | |
|---|---|---|---|---|
| 3,665,358 A | | 5/1972 | Lueck et al. | |
| 4,587,506 A | * | 5/1986 | Hoeksma | 336/178 |
| 4,596,974 A | * | 6/1986 | Tobben et al. | 336/197 |
| 4,939,494 A | * | 7/1990 | Masuda et al. | 336/96 |
| 5,420,559 A | * | 5/1995 | Ohshiba et al. | 336/208 |
| 6,369,680 B1 | | 4/2002 | Brinckmann et al. | |
| 2003/0030534 A1 | * | 2/2003 | Gu et al. | 336/221 |

FOREIGN PATENT DOCUMENTS

| | | | |
|---|---|---|---|
| FR | 1400837 | | 5/1965 |
| GB | 946351 | | 1/1964 |
| JP | 55105310 | | 8/1980 |
| JP | 08/203754 | * | 9/1996 |

* cited by examiner

*Primary Examiner*—Tuyen T Nguyen
(74) *Attorney, Agent, or Firm*—Ziolkowski Patent Solutions Group, SC

(57) ABSTRACT

The present invention is directed to a bobbin for an inductor assembly that is preferably molded of a plastic material incorporating a flange to maintain a uniform and constant gap or separation between a pair of ferrite E-cores. Preferably, the bobbin includes a number of hollow bosses designed to receive self-tapping screws so as to directly mount the bobbin to a mounting plate. Additionally, a pair of tempered brass spring clips is used to secure the cores to the bobbin. To reduce breakage of the bobbin, each clip engages the bobbin perpendicular to the width of the ferrite core.

21 Claims, 4 Drawing Sheets

INDUCTOR ASSEMBLY

BACKGROUND OF INVENTION

The present invention relates generally to welding-type devices and, more particularly, to an inductor assembly having a molded bobbin so as to maintain a uniform gap between a pair of ferrite cores.

Inductor assemblies are commonly used with welding-type devices to condition a power signal from a power supply so that it may be used in the welding process. For example, inductor assemblies are often implemented in a boost converter assembly. Boost converters are frequently used so that the welding device may be operated on a variable voltage source. That is, the boost converter enables the welding device to be operable with voltages ranging typically from 115 volts to 230 volts. Typically, the signal is input to a rectifier that in turn outputs the rectified power signal to the boost converter for conditioning whereupon the boost converter outputs a conditioned signal to the inverter of the welding device and creates AC power for welding transformers of the welding device.

Typically, the boost converter or inductor assembly includes a pair of ferrite cores and several turns of magnetic wire that are collectively supported by a bobbin. Generally, shims are used to maintain a sufficient and constant gap between the two ferrite cores. Clips, typically fabricated from stainless steel, are then used to secure the ferrite cores to the bobbin. Customarily, the stainless steel clips are oriented to be parallel to the length of the cores. As a result, the clips "snap" onto protrusions on extreme ends of the bobbin. This configuration coupled with the bobbin being formed of notch-sensitive and extremely brittle material often results in bobbin breakage during the winding process where the winding stresses are typically very high.

Standard E-core inductors require shims or a ground center leg to formulate the necessary gap between the cores. These standard assemblies typically utilize a cylindrical sleeve designed to receive, at each end, the inner pole of an E-core such that the outer legs or pole of the E-cores are positioned outside the sleeve. As such, shims are used to maintain a gap between the facing outer poles. These shims increase the size and weight of the inductor assembly, but also lead to increased tooling and manufacturing costs. In other assemblies or in conjunction with the outer shims, the center pole is ground to a shorter length than the outer pole so that the gap between the inner poles is greater than the outer poles. This requires additional grinding of the core which yields greater tooling and manufacturing costs.

Adding to the complexity of these inductor assemblies is the mounting means by which the inductor assembly is secured within the boost converter. Typically, the mounting means for the inductor assembly is built into the brackets or clips used to hold the cores tight against one another. As a result, the bobbin is secondarily secured to a mounting plate.

It would therefore be desirable to design an inductor assembly having a bobbin that maintains the requisite distance between a pair of ferrite cores absent additional gap shims. It is also desirable to configure the bobbin so as to be directly mountable to a mounting plate. It would also be desirable to configure the bobbin to receive a pair of securing devices designed to secure the E-cores to the bobbin with reduced likelihood of bobbin breakage.

BRIEF DESCRIPTION OF INVENTION

The present invention is directed to a bobbin for an inductor assembly that is preferably molded of a plastic material incorporating a flange to maintain a uniform and constant gap or separation between a pair of ferrite E-cores. Preferably, the bobbin includes a number of hollow bosses designed to receive self tapping screws so as to directly mount the bobbin to a mounting plate. Additionally, a pair of tempered brass spring clips is used to secure the cores to the bobbin. To reduce breakage of the bobbin, each clip engages the bobbin perpendicular to the width of the ferrite core. All of which overcome the aforementioned drawbacks.

Therefore, in accordance with one aspect of the present invention, a bobbin for an inductor assembly is provided. The bobbin includes a molded body having a first and a second end. Disposed between the first and second ends is a single flange. The flange is centrally disposed between the ends so as to maintain a uniform gap between a pair of ferrite cores.

In accordance with another aspect of the present invention, an inductor assembly includes a pair of ferrite cores and a plastic bobbin. The bobbin includes an embossed flange to maintain a constant gap between the pair of ferrite cores. A pair of securing devices is also provided to secure the pair of ferrite cores to the plastic bobbin.

In accordance with yet another aspect of the present invention, a kit for retrofitting an inductor assembly of a welding-type device is provided. The kit includes a pair of ferrite cores as well as a molded bobbin. The molded bobbin includes a centrally positioned flange configured to engage opposing faces of the pair of ferrite cores so as to maintain a uniform separation between the pair of ferrite cores. The kit also includes a pair of spring clips to secure the pair of ferrite cores to the molded bobbin.

Various other features, objects and advantages of the present invention will be made apparent from the following detailed description and the drawings.

BRIEF DESCRIPTION OF DRAWINGS

The drawings illustrate one preferred embodiment presently contemplated for carrying out the invention.

In the drawings.

DETAILED DESCRIPTION

The present invention is directed to an inductor assembly that is particularly applicable as a boost converter in a welding-type device such as a Gas Tungsten Arc Welding (GTAW) system similar to the Maxstar® series of systems marketed by the Miller Electric Manufacturing Company of Appleton, Wis. Maxstar® is a registered trademark of Miller Electric Manufacturing Company of Appleton, Wis.

As one skilled in the art will fully appreciate the hereinafter description of welding devices not only includes welders but also includes any system that requires high power outputs, such as heating and cutting systems. Therefore, the present invention is equivalently applicable with any device requiring high power output, including welders, plasma cutters, induction heaters, and the like. Reference to welding power, welding-type power, or welders generally, includes welding, cutting, or heating power. Description of a welding apparatus illustrates just one embodiment in which the present invention may be implemented. The present invention is equivalently applicable with systems such as cutting and induction heating systems.

Figure 1:
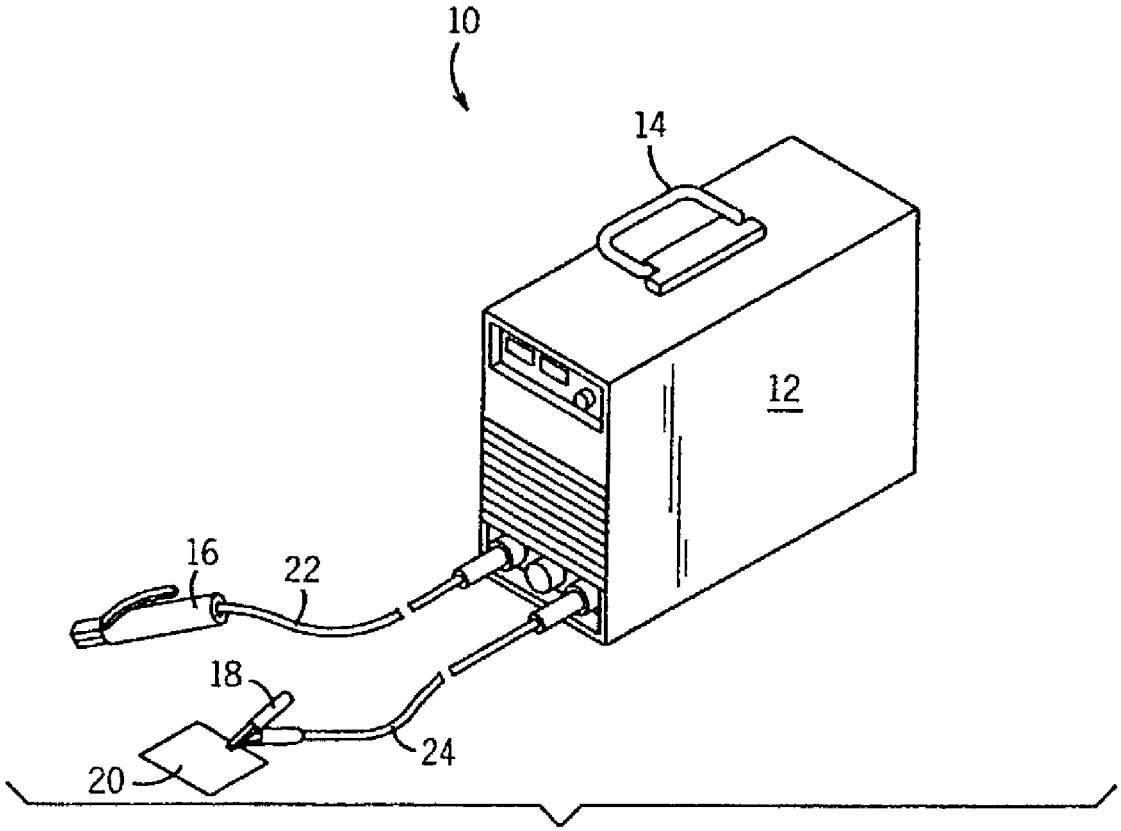
FIG. 1 is a perspective view of a welding-type device incorporating the present invention.

Referring now to FIG. 1, a perspective view of a welding device incorporating the present invention is shown. Welding device 10 includes a housing 12 enclosing the internal components of the welding device including an inductor assembly of a boost converter as will be described in greater detail below. Optionally, the welding device 10 includes a handle 14 for transporting the welding system from one location to another. To effectuate the welding process, the welding device includes a torch 16 as well as a work clamp 18. The work clamp 18 is configured to ground a workpiece 20 to be welded. As is known, when the torch 16 is in relative proximity to workpiece 20, a welding arc or cutting arc, depending upon the particular welding-type device, results. Connecting the torch 16 and work clamp 18 to the housing 12 is a pair of cables 22 and 24, respectively.

Figure 2:
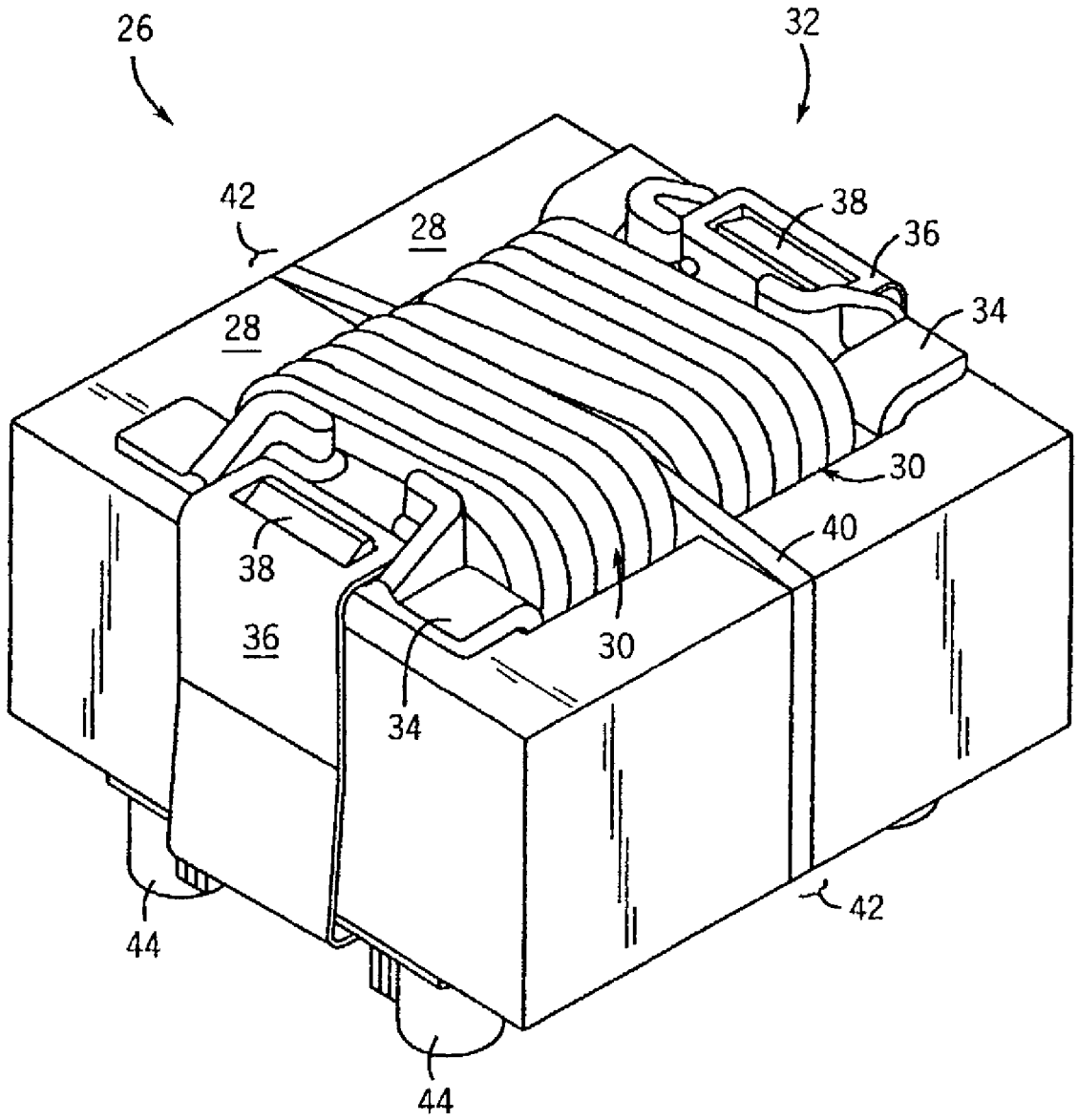
FIG. 2 is a perspective view of an assembled inductor assembly in accordance with the present invention.

Referring now to FIG. 2, an inductor assembly 26 in accordance with the present invention is shown. While the inductor assembly 26 is applicable for a number of implementations, the assembly is particularly useful in the boost converter assembly of a welding-type device. A boost converter is commonly used to condition an input power signal so that the welding-type device may be operable on a 115–230 volt line. As indicated previously, the boost converter receives a rectified input signal and outputs a conditioned signal that may be used by an inverter to create the requisite AC signal for the welding transformers.

Inductor assembly 26 includes a pair of cores 28 formed of a ferrite material. Preferably, the cores 28 have an e-shape. Wire 30 is disposed about the inner pole (not shown) of each E-core to form a coil. The inductor assembly 26 further includes a molded bobbin 32 that supports the cores 28 and coil 30. The bobbin is preferably fabricated from a moldable material that is extremely stiff and strong when exposed to high temperatures.

Bobbin 32 is defined by a pair of ends 34. Each end 34 is configured to receive a spring clip 36. Preferably, each spring clip is fabricated from spring temper brass material to reduce eddy current heating. As shown in FIG. 2, each spring clip 36 is designed to engage the molded bobbin 32 perpendicularly to the general length of the ferrite core. Moreover, each clip 36 includes a pair of holes 36*a* (FIG. 3) configured to receive a ramp portion 38 or other protrusion located on the top and bottom surface of each end of the molded bobbin. The ramps include a shoulder and fillet that provides an engagement point with the spring clips thereby eliminating a stress concentration on the ferrite core directly. That is, the ramp/clip combination avoids a potentially damaging bending moment that would otherwise be caused by the force acting on the core from the clip.

Centrally disposed between ends 34 and integrally molded within the bobbin 32 is flange 40. As will be described in greater detail with respect to FIG. 3, flange 40 has a thickness that provides a uniform gap or separation 42 between the outer poles of the ferrite cores.

As will be described in greater detail with respect to FIG. 4, the bobbin 32 includes a number of hollow screw bosses 44 that are integrally molded with the bobbin. Bosses 44 are designed to receive a threaded fastener such as a self-tapping screw for affixing the inductor assembly to a mounting plate or other support structure.

Figure 3:
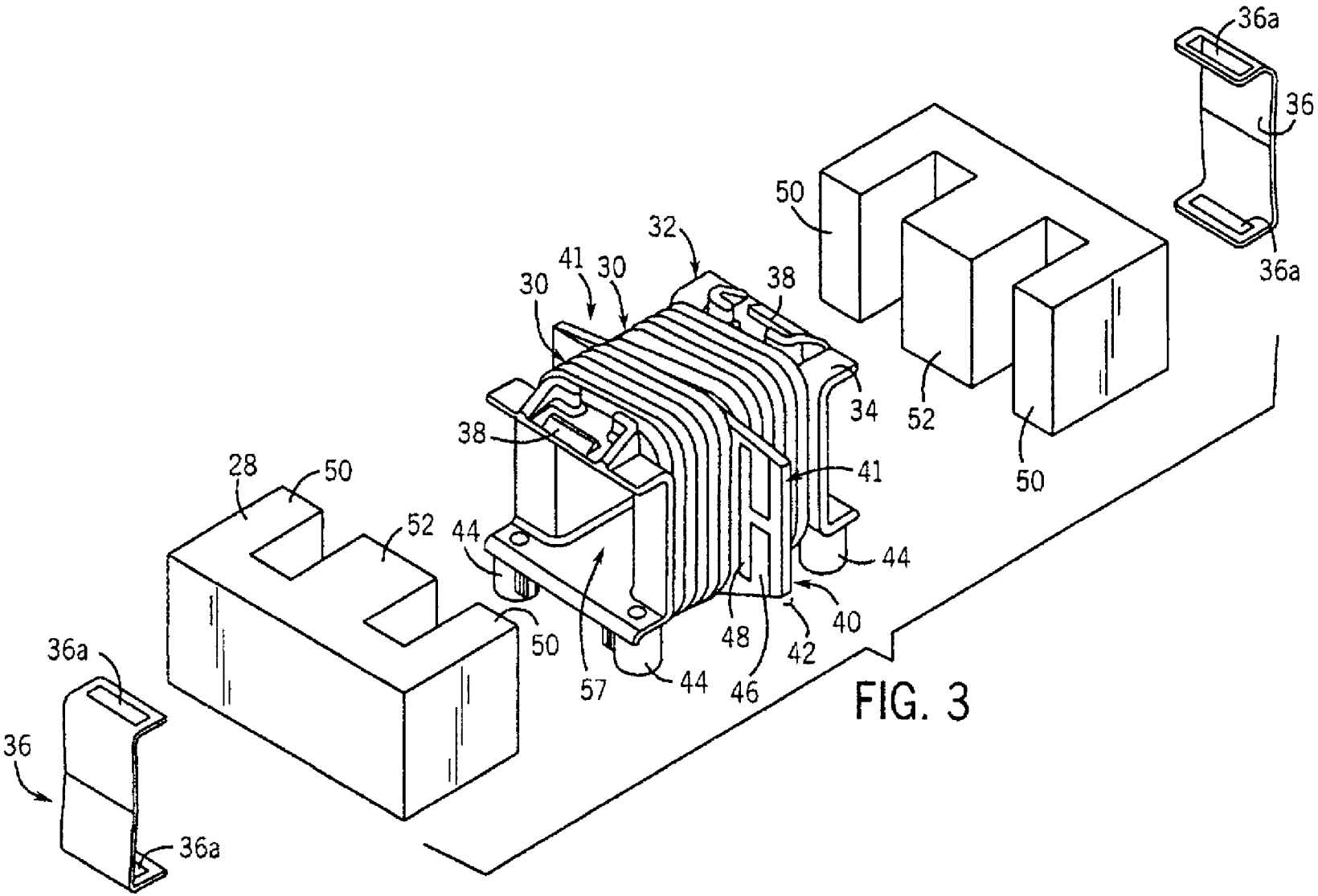
FIG. 3 is an exploded view of that shown in FIG. 2.

Referring now to FIG. 3, an exploded view of that shown in FIG. 2 is illustrated. The molded bobbin 32, as indicated previously, is designed to support the pair of ferrite cores 28 and a coil assembly 30. Centrally disposed between each end of the molded bobbin and integrally formed with the bobbin is flange 40. Flange 40 is configured such that a pair of ends 41 extends past the body of the bobbin. As such, each end 41 includes a pair of faces 46 designed to engage respective poles of the ferrite cores.

Flange 40 is constructed such that a uniform gap or separation 42 results between the pair of cores 28 when properly positioned in the bobbin. That is, flange 40 has a width that matches the desired separation between the pair of cores. As is known, the gap or separation between the pole faces of the ferrite cores together with the number of turns of wire and the type of core material determine the inductance and saturation current of an inductor. As such, the width of flange 40 is constructed to meet the design requirements, i.e. inductance and saturation current of the inductor, for the particular welding-type device.

Alternately, however, each face 46 may incorporate an embossed portion 48. As such, a gap or separation between the cores greater than the nominal wall thickness of the flange may be achieved. For example, at least one face 46 at each end may be molded to include an "H" using standard tooling. The embossed H together with the thickness of the flange would then provide the desired separation or gap between the outer poles 50 of the ferrite cores.

As previously described, bobbin 32 is constructed to support E-cores 28. As such, bobbin 32 includes a central chamber 57 constructed to receive the inner pole 52 of each core structure 28.

Figure 4:
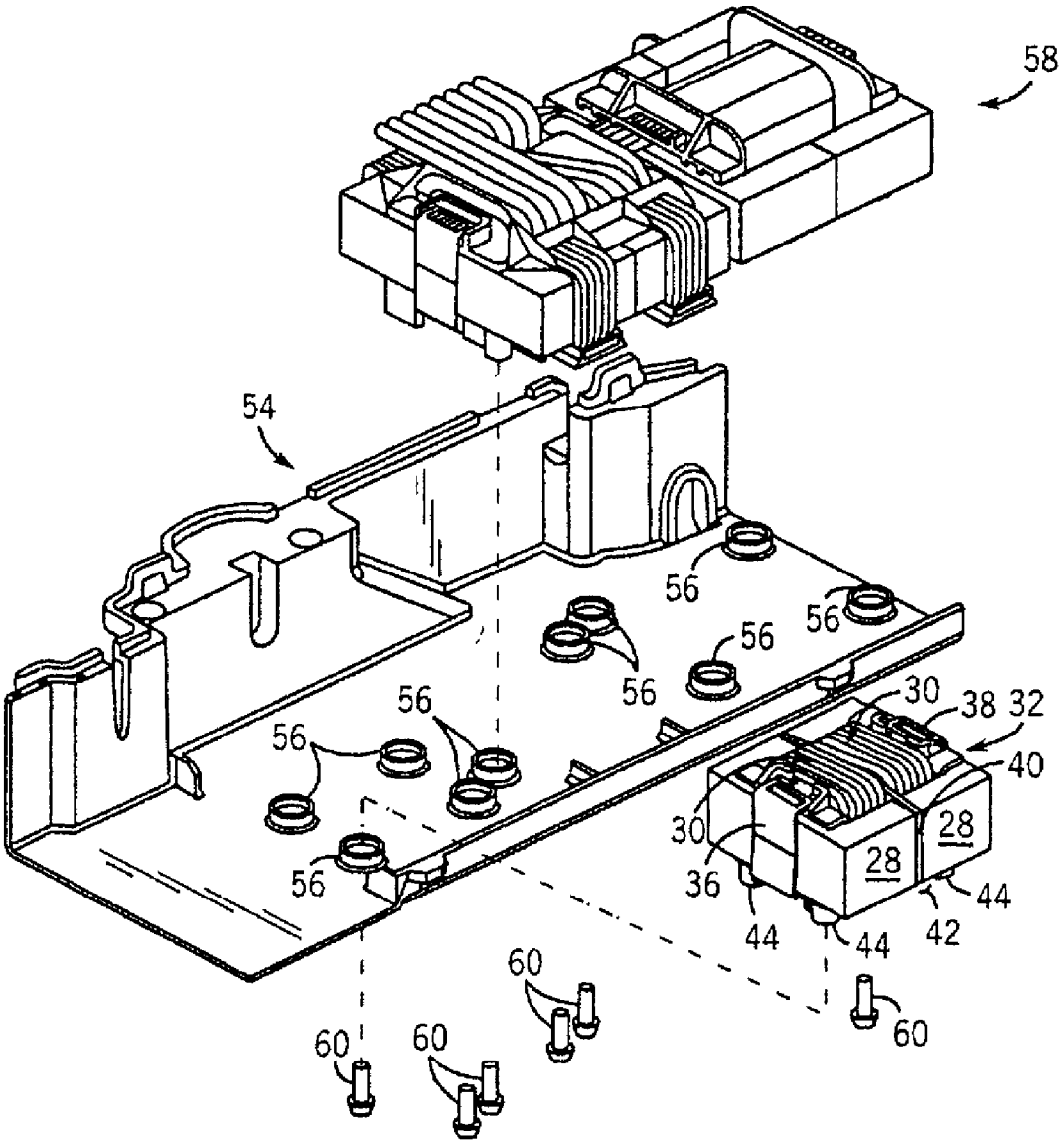
FIG. 4 is an exploded view of a portion of a boost converter incorporating the present invention.

Referring now to FIG. 4, the inductor assembly 26 is shown as mountable to a mounting plate 54. Mounting plate 54 includes a number of locating bosses 56 that are configured to receive corresponding molded screw bosses 44 of the inductor assembly. The molded screw bosses 44 as well as locating bosses 56 eliminate the need for a set of mounting brackets and clamping screws. A transformer assembly 58 may also be affixed to mounting plate 54. Preferably, steel self-tapping screws 60 are used to affix the inductor assembly 26 to mounting plate 54. That is, the self-tapping screws 60 are inserted through the locating bosses 56 and corresponding screw bosses 44 of the inductor assembly for securely fastening the inductor assembly to the mounting plate. While self-tapping screws are particularly applicable for a plastic bracket other fasteners such as a threaded bolt could be used to secure the inductor assembly to the mounting plate.

During the assembly process, the wire is first wound about the bobbin. The ferrite cores are then inserted into the molded bobbin structure. The tempered brass clips are then attached to the bobbin. Initially, each clip engages the ferrite core in the middle. The clip is then further depressed until each rectangular hole 36*a* engages a corresponding ramp 38. The reaction force from deflecting the clip 36 causes the cores to be pushed together tightly against the flange 40. Because the ramp is located on the main portion of the bobbin, there is less likelihood of core breakage due to where the force on the core is applied. Once all the rectangular holes 36*a* have been properly secured about ramps 38, the ferrite cores are properly positioned relative to the bobbin structure and properly spaced from one another as a result of flange 40.

While the present invention has been described with respect to the use of spring clips to properly secure the cores to the bobbin structure, glues and other structures may equivalently be used. That is, glues, bands, tapes, and other brackets may be equivalently used without deviating from the spirit and scope of the present application.

Therefore, in accordance with one embodiment of the present invention, a bobbin for an inductor assembly is provided. The bobbin includes a molded body having a first and a second end. Disposed between the first and second ends is a single flange. The flange is centrally disposed between the ends so as to maintain a uniform gap between a pair of ferrite cores.

In accordance with another embodiment of the present invention, an inductor assembly includes a pair of ferrite cores and a plastic bobbin. The bobbin includes an embossed flange to maintain a constant gap between the pair of ferrite cores. A pair of securing devices is also provided to secure the pair of ferrite cores to the plastic bobbin.

In accordance with yet another embodiment of the present invention, a kit for retrofitting an inductor assembly of a welding-type device is provided. The kit includes a pair of ferrite cores as well as a molded bobbin. The molded bobbin includes a centrally positioned flange configured to engage opposing faces of the pair of ferrite cores so as to maintain a uniform separation between the pair of ferrite cores. The kit also includes a pair of spring clips to secure the pair of ferrite cores to the molded bobbin.

The present invention has been described in terms of the preferred embodiment, and it is recognized that equivalents, alternatives, and modifications, aside from those expressly stated, are possible and within the scope of the appending claims.

What is claimed is:

1. A bobbin for an inductor assembly comprising:

a molded body having a first end, a second end, and a single flange centrally disposal between the first and the second ends, the single flange having a pair of faces wherein at least one of the pair of faces is generally non-planar, the pair of faces constructed to directly engage a pair of ferrite cores such that a uniform gap substantially similar to the greatest distance between the pair faces is formed between the pair of ferrite cores.

2. The bobbin of claim 1 wherein the flange includes a pair of ends, each end extending past the molded body.

3. The bobbin of claim 2 wherein each end of the flange includes a pair of faces and each of the pair of faces includes at least one face that is generally non-planar, each generally non-planar face having an embossed surface.

4. The bobbin of claim 3 wherein each embossed surface is configured to engage a pole of a ferrite core.

5. The bobbin of claim 1 further comprising a protrusion configured to engage a spring clip for securing the pair of ferrite cores to the molded body.

6. The bobbin of claim 1 further comprising a number of hollow bosses, each hollow boss configured to receive a threaded fastener for mounting the molded body to a mounting plate.

7. The bobbin of claim 1 wherein the flange is configured to bisect the molded body.

8. An inductor assembly comprising:

a pair of ferrite cores;

a plastic bobbin, the bobbin having an embossed flange to maintain a constant gap between the pair of ferrite cores; and a pair of securing devices oriented transversely to the pair of ferrite cores to secure the pair of ferrite cores to the plastic bobbin.

9. The inductor assembly of claim 8 wherein the pair of securing devices includes a pair of spring clips, each spring clip designed to engage a molded protrusion on the bobbin to secure the ferrite cores to the bobbin.

10. The inductor assembly of claim 9 wherein the spring clips are formed of brass to minimize any eddy current heating.

11. The inductor assembly of claim 8 wherein the ferrite cores have an E-shape.

12. The inductor assembly of claim 8 wherein each core has a pole piece and the flange maintains the uniform gap between outer poles of the ferrite cores.

13. The inductor assembly of claim 8 wherein the bobbin includes a number of hollow bosses, each hollow boss configured to receive a screw to mount the inductor assembly to a bracket.

14. The inductor assembly of claim 8 incorporated into a welding-type device.

15. A kit for retrofitting an inductor assembly of a welding-type device, the kit comprising:

a pair of ferrite cores;

a molded bobbin having a centrally positioned non-planar flange having a maximum thickness and configured to engage opposing faces of the pair of ferrite cores so as to maintain a uniform separation between the pair of ferrite cores, wherein the maximum thickness of the flange is no greater than a distance of the uniform separation; and a pair of spring clips to secure the pair of ferrite cores to the molded bobbin.

16. The kit of claim 15 wherein the molded bobbin includes hollow bosses for receiving threaded fasteners to secure the molded bobbin to a mounting plate.

17. The kit of claim 15 wherein the securing devices are formed of a brass material.

18. The kit of claim 15 wherein the securing devices are configured to be oriented perpendicular to the molded bobbin.

19. The kit of claim 15 wherein the bobbin includes a molded body and the flange includes a pair of ends, each end extending past the molded body and having at least one embossed surface configured to engage a portion of a ferrite core so as to maintain the uniform separation between the pair of ferrite cores.

20. A bobbin for an inductor assembly comprising:

a molded body having a first end, a second end, and a single flange centrally disposed between the first and the second ends to maintain a uniform gap between a pair of ferrite cores, the single flange having a pair of ends, each end extending past the molded body and including a pair of faces, at least one face of each end having an embossed surface defining a portion of the uniform gap.

21. The bobbin of claim 20 wherein each embossed surface is configured to engage a pole of a ferrite core.

* * * * *

UNITED STATES PATENT AND TRADEMARK OFFICE

CERTIFICATE OF CORRECTION

PATENT NO. : 7,046,111 B2
APPLICATION NO. : 10/065773
DATED : May 16, 2006
INVENTOR(S) : Sigl, Dennis R.

It is certified that error appears in the above-identified patent and that said Letters Patent is hereby corrected as shown below:

Col 5, line 34 (claim 1), delete "disposal" and substitute therefore -- disposed --.

Signed and Sealed this

Twelfth Day of September, 2006

JON W. DUDAS
*Director of the United States Patent and Trademark Office*